US011859943B2

(12) United States Patent
Winters

(10) Patent No.: US 11,859,943 B2
(45) Date of Patent: Jan. 2, 2024

(54) DART PISTOL

(71) Applicant: Edward Winters, Kentwood, MI (US)

(72) Inventor: Edward Winters, Kentwood, MI (US)

( * ) Notice: Subject to any disclaimer, the term of this patent is extended or adjusted under 35 U.S.C. 154(b) by 0 days.

(21) Appl. No.: 17/679,870

(22) Filed: Feb. 24, 2022

(65) Prior Publication Data

US 2022/0333892 A1 Oct. 20, 2022

Related U.S. Application Data

(60) Provisional application No. 63/176,556, filed on Apr. 19, 2021.

(51) Int. Cl.

| | |
|---|---|
| ***F41B 7/08*** | (2006.01) |
| ***F41B 7/00*** | (2006.01) |
| ***A63F 9/02*** | (2006.01) |
| ***F42B 6/00*** | (2006.01) |

(52) U.S. Cl.

CPC ..... *F41B 7/003* (2013.01); *A63F 9/02* (2013.01); *F41B 7/08* (2013.01); *F42B 6/003* (2013.01)

(58) Field of Classification Search

CPC ..... F41B 7/003; F41B 7/08; F42B 6/003
USPC ..... 124/27; 446/63, 65
See application file for complete search history.

(56) References Cited

U.S. PATENT DOCUMENTS 1,063,803 A * 6/1913 Jones ..... F41B 7/00 124/29
1,541,579 A * 6/1925 Kikta ..... A63H 27/14 446/65
1,565,437 A * 12/1925 Greife ..... A63H 27/14 446/65
1,827,023 A * 10/1931 Keseleff ..... F41B 3/005 124/37
2,017,778 A * 10/1935 Vido ..... F41B 7/08 446/444
2,106,400 A * 1/1938 Brethen ..... F41B 7/003 124/27
2,321,077 A * 6/1943 Gora ..... F41B 7/003 124/16
2,426,437 A * 8/1947 Cole ..... F41B 3/005 446/65

(Continued)

FOREIGN PATENT DOCUMENTS

EP 1866593 B1 3/2012

OTHER PUBLICATIONS

Beck, David, How do Nerf guns work?, Quora, 2013 <URL: https://www.quora.com/How-do-Nerf-guns-work>.

*Primary Examiner* — Alexander R Niconovich

(57) ABSTRACT

A dart pistol utilizes an assembly of a pistol body, a launch channel, a carriage, a mainspring, an operating bar, an engagement feature, a trigger member, and a retainer pin to adapt a conventional game of throwing darts into a shooting sport. The launch channel is formed into the pistol body such that the carriage, mainspring, and operating bar are slidably mounted between a fore body end and a rear body end. The mainspring is connected between the carriage and the fore body end to impart a launching force to at least one projectile via the carriage. The retainer pin is laterally mounted into the channel to capture the engagement feature of the operating bar until dislodged by the trigger member. The trigger member is pivotably mounted to the pistol body, operatively coupling the trigger member to the operating bar to fire the dart pistol.

8 Claims, 10 Drawing Sheets

(56) References Cited

U.S. PATENT DOCUMENTS 2,663,291 A * 12/1953 Hall ..... F41B 3/005 446/54
2,976,644 A * 3/1961 Crisci ..... A63H 27/005 473/585
3,124,119 A * 3/1964 Ayala ..... F41B 1/00 273/348.2
3,437,084 A * 4/1969 Hyter ..... F41B 7/025 124/19
3,859,977 A * 1/1975 Lange ..... F41B 11/00 124/66
3,968,784 A * 7/1976 Miller ..... F41B 7/003 124/31
4,016,854 A * 4/1977 Lehman ..... F41B 7/08 446/260
4,059,089 A * 11/1977 Lehman ..... F41B 7/08 42/76.01
4,212,285 A * 7/1980 Cagan ..... F41B 11/00 124/67
5,253,873 A * 10/1993 Grattan ..... F41B 7/00 124/16
5,355,866 A * 10/1994 Hunter ..... F41B 7/003 124/16
5,645,038 A * 7/1997 Luk ..... F41B 11/642 124/67
6,048,280 A * 4/2000 Palmer ..... F41B 11/71 124/16
6,076,513 A * 6/2000 Doherty ..... F41B 11/642 124/66
6,179,680 B1 * 1/2001 Hornsby ..... A63H 27/14 446/65
6,732,725 B2 * 5/2004 Doud ..... F41B 7/003 124/27
7,703,448 B2 * 4/2010 Chia ..... F41B 7/08 124/29
9,097,484 B2 * 8/2015 Poirier ..... F41B 11/642

* cited by examiner

DART PISTOL

The current application claims a priority to the U.S. Provisional Patent application Ser. No. 63/176,556 filed on Apr. 19, 2021.

FIELD OF THE INVENTION

The present invention relates generally to an apparatus for a pistol facsimile. More specifically, the present invention is an apparatus for a projectile-launching toy used to launch darts as part of an organized game of skill.

BACKGROUND OF THE INVENTION

Darts, or dart-throwing specifically, is a popular party game involving the precise throwing of spiked missiles onto a target. Across a variety of game-types and rulesets, the impact location on the game-target corresponds to a point value or scoring condition according to the perceived difficulty of each throw or shot. To wit—the more precisely the player can place their shot, the higher they will score. This is not dissimilar from other types of conventional shooting sports, archery, or other projectile-based games of skill in concept. However, it is recognized that throwing darts requires a measure of gross muscle control that may prevent darts from appealing to a wider audience. This inherent limitation is not present in many other shooting sports, where the skill of each individual player is represented by their own precise operation of a projectile-launcher.

Accordingly, the present invention provides a means of adapting a conventional darts-type game into a more conventional shooting sport by introducing a projectile launching apparatus, i.e., the dart pistol. The proposed apparatus incorporates a variety of embodiments and adjustable features to adapt to various players and preferences, including adjustments to the scale and power of the dart pistol by exchanging various components to be described herein. Further, the precise manual of arms and operation, or effective 'difficulty' of using the present invention, may be intentionally increased to force users (players) to compete at a higher level of skill.

Additional advantages of the invention will be set forth in part in the description which follows, and in part will be obvious from the description, or may be learned by practice of the invention. Additional advantages of the invention may be realized and attained by means of the instrumentalities and combinations particularly pointed out in the detailed description of the invention section. Further benefits and advantages of the embodiments of the invention will become apparent from consideration of the following detailed description given with reference to the accompanying drawings, which specify and show preferred embodiments of the present invention.

DETAIL DESCRIPTIONS OF THE INVENTION

Figure 1:
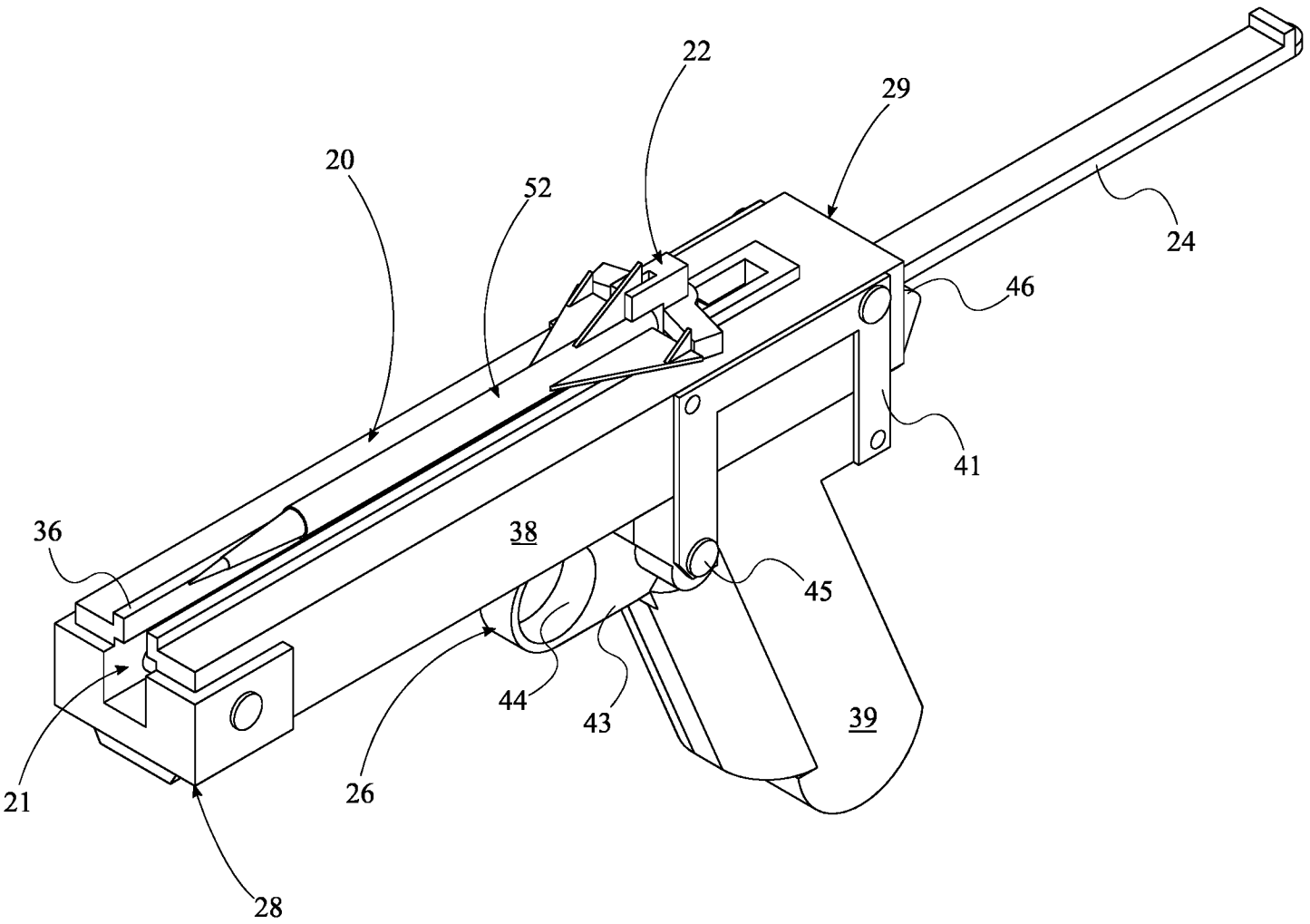
FIG. 1 is a top-front-left perspective view of the present invention, wherein the present invention is loaded and ready to fire.

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

In reference to FIG. 1 through 8, the present invention is a dart pistol comprising a pistol body 20, a launch channel 21, a carriage 22, an operating bar 24, an engagement feature 25, a mainspring 23, a trigger member 26, and a retainer pin 27.

Figure 2:
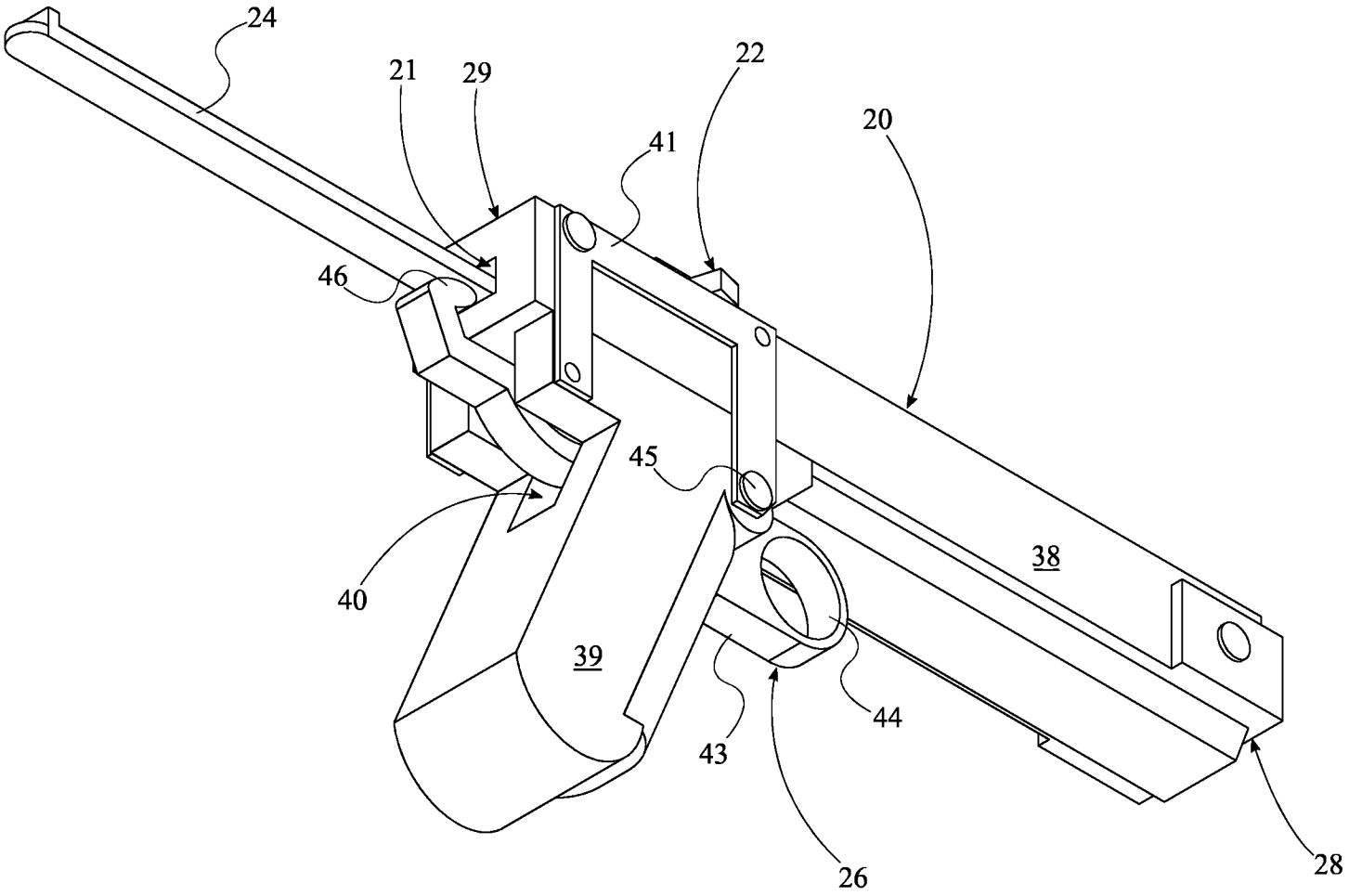
FIG. 2 is a bottom-right-rear perspective view thereof.
Figure 3:
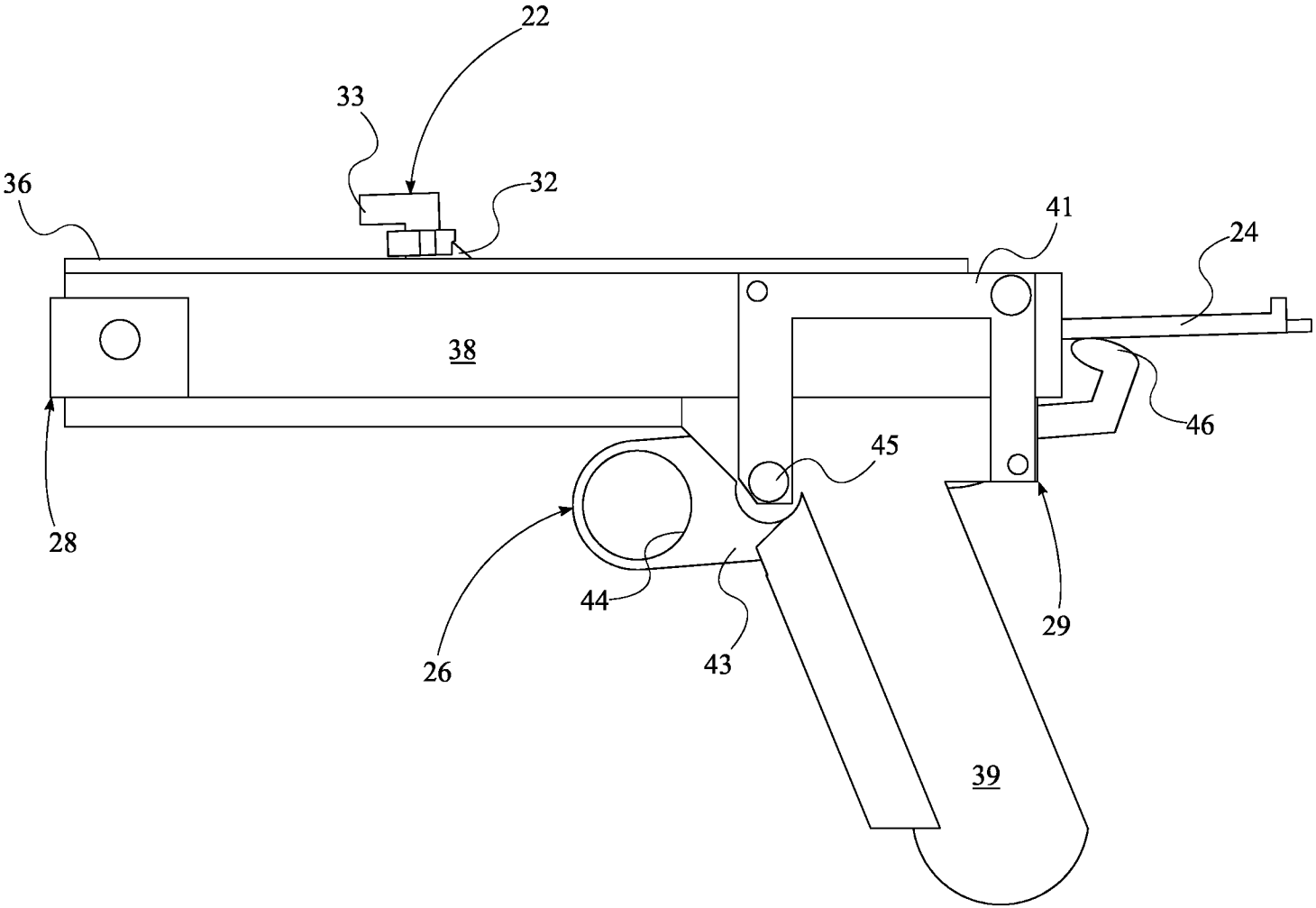
FIG. 3 is a left-side elevational view thereof.
Figure 4:
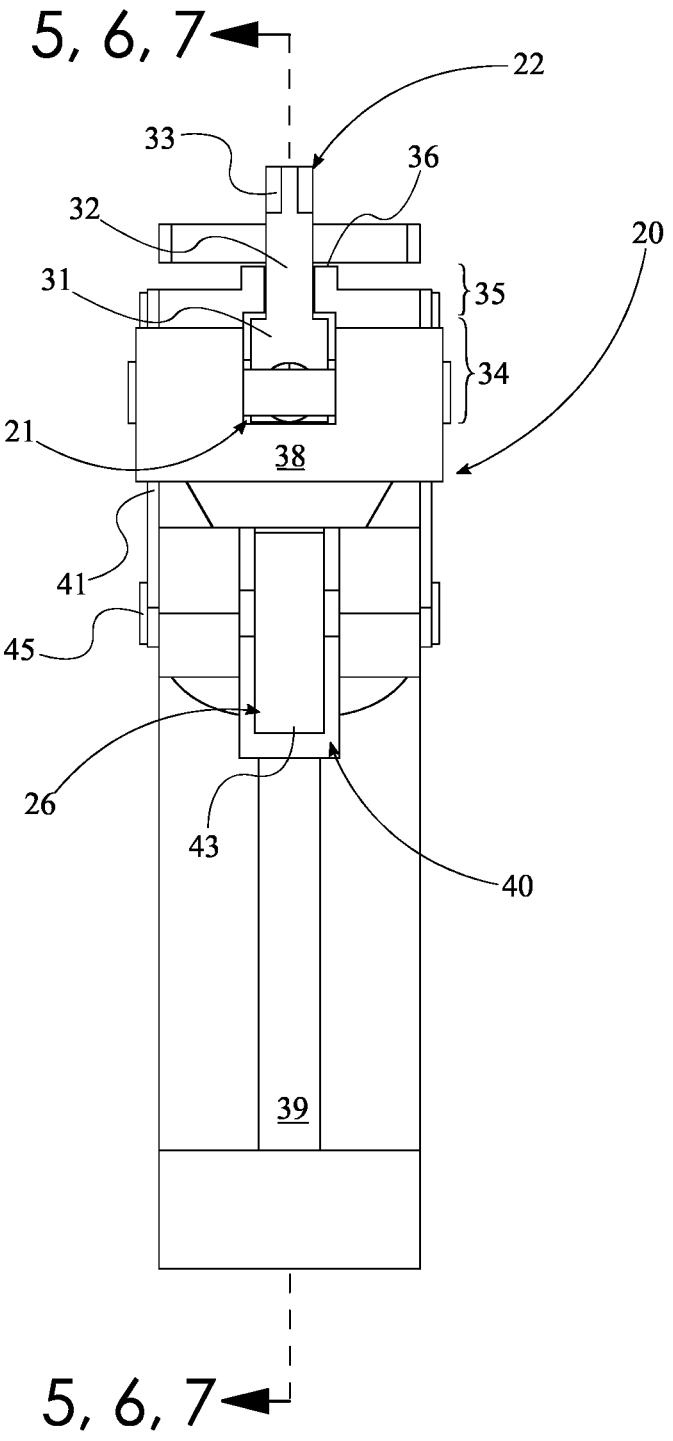
FIG. 4 is a front elevational view thereof.

The pistol body 20 constitutes a rigid structural body generally resembling a pistol or other handgun-analog as shown in FIGS. 1 and 2, though the broader conceptions of the present invention enable the pistol body 20 to be extended or remolded into any form factor as may be realized by a reasonably skilled individual. Across multiple embodiments, the pistol body 20 comprises a fore body end 28 and a rear body end 29 analogous to the muzzle and the butt of most conventional weapons, respectively. The launch channel 21 traverses into the pistol body 20 from the fore body end 28 as shown in FIG. 1. The launch channel 21 provides guidance and support to the firing assembly of the present invention, specifically guiding the carriage 22 along a linear path defined within the launch channel 21. Accordingly, the carriage 22 is slidably mounted along the launch channel 21 with appropriate tolerances to the inner surfaces of the launch channel 21 to permit free motion therethrough.

Figure 5:
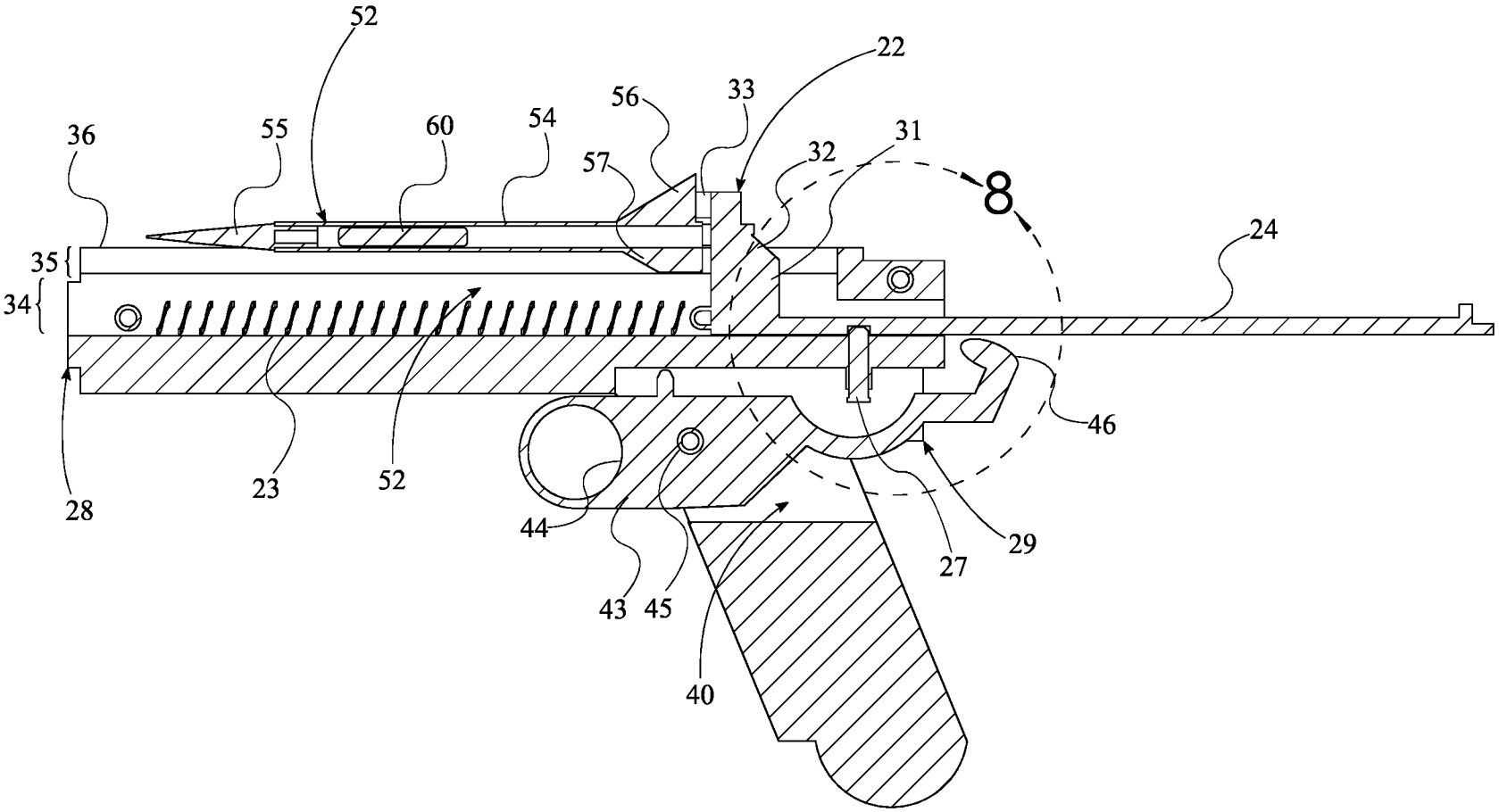
FIG. 5 is a cross-section view taken along line 5-5in FIG. 4, wherein the present invention is loaded and ready to fire.
Figure 6:
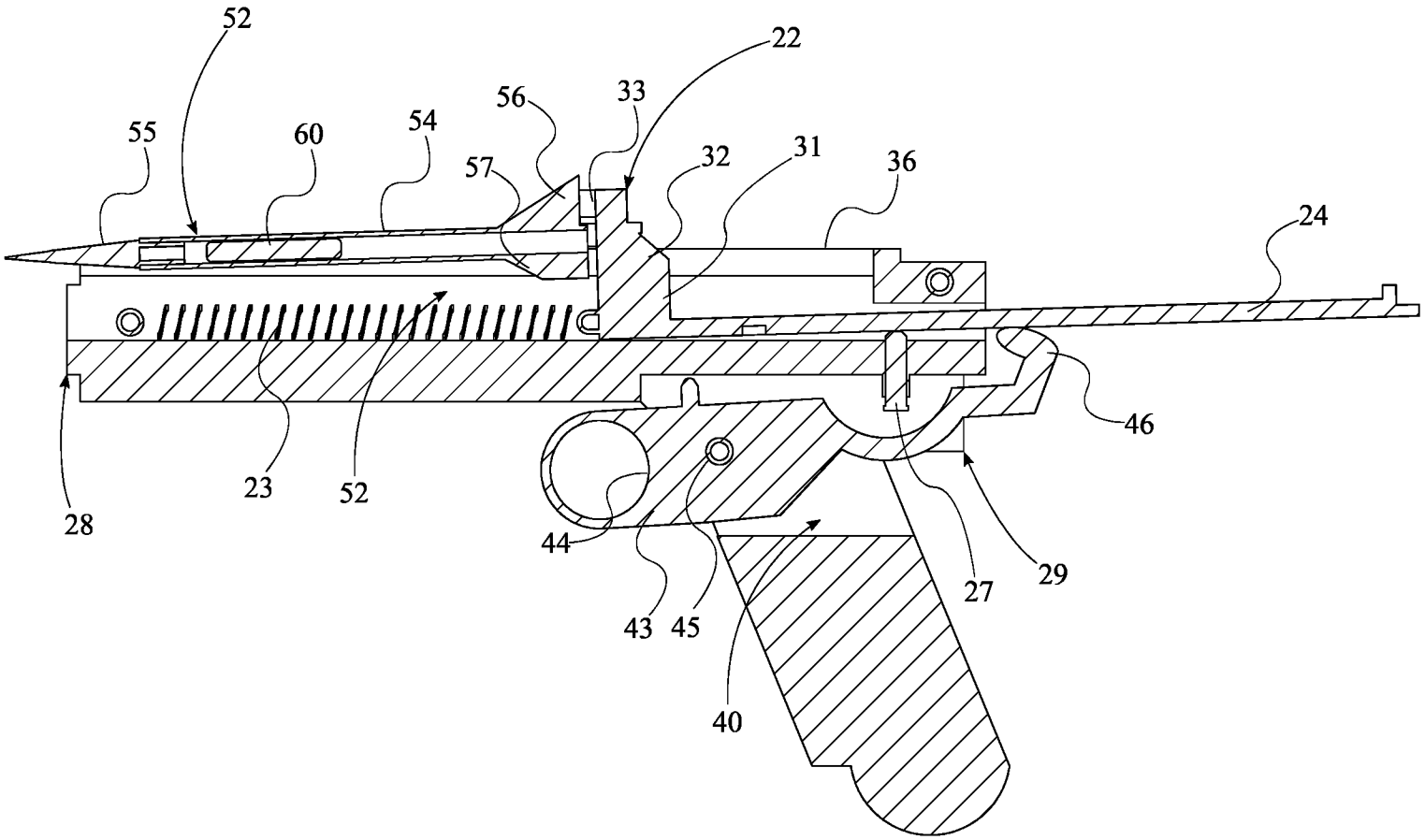
FIG. 6 is a cross-section view taken along line 6-6 in FIG. 4, wherein the present invention is in the process of firing.
Figure 7:
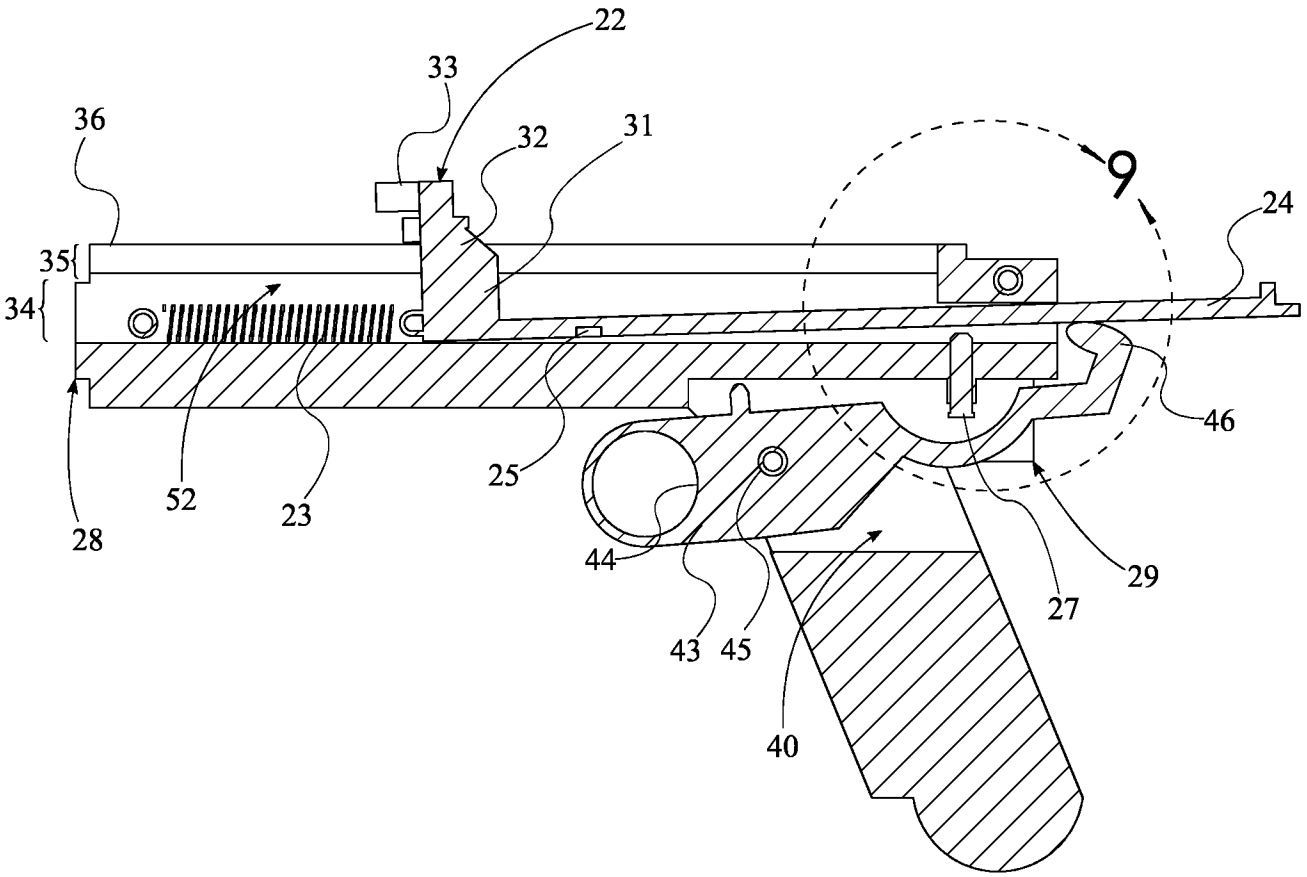
FIG. 7 is a cross-section view taken along line 7-7 in FIG. 4, wherein the present invention has been misfired, limiting the launch velocity of at least one projectile.

The mainspring 23 constitutes a metallic coil-spring of suitable strength to propel the carriage 22 forward under retraction, thereby providing the necessary acceleration to the at least one projectile 52 to affect a launch. Accordingly, the mainspring 23 is connected in between the pistol body 20 and the carriage 22 as shown in FIG. 5 through 7. This connection is ideally releasable to allow a user to exchange the mainspring 23 for another iteration of greater or lesser power, affording a player with the ability to extend or limit the launch-range of the present invention. Further, the mainspring 23 may be exchanged to accommodate various embodiments of the at least one projectile 52, i.e., embodiments of greater or lesser total mass.

The carriage 22 is terminally connected to the operating bar 24 as shown in FIGS. 1 and 6 as a combined cocking handle and as a portion of the fire-control group, in combination with the trigger member 26 and the retainer pin 27.

Figure 8:
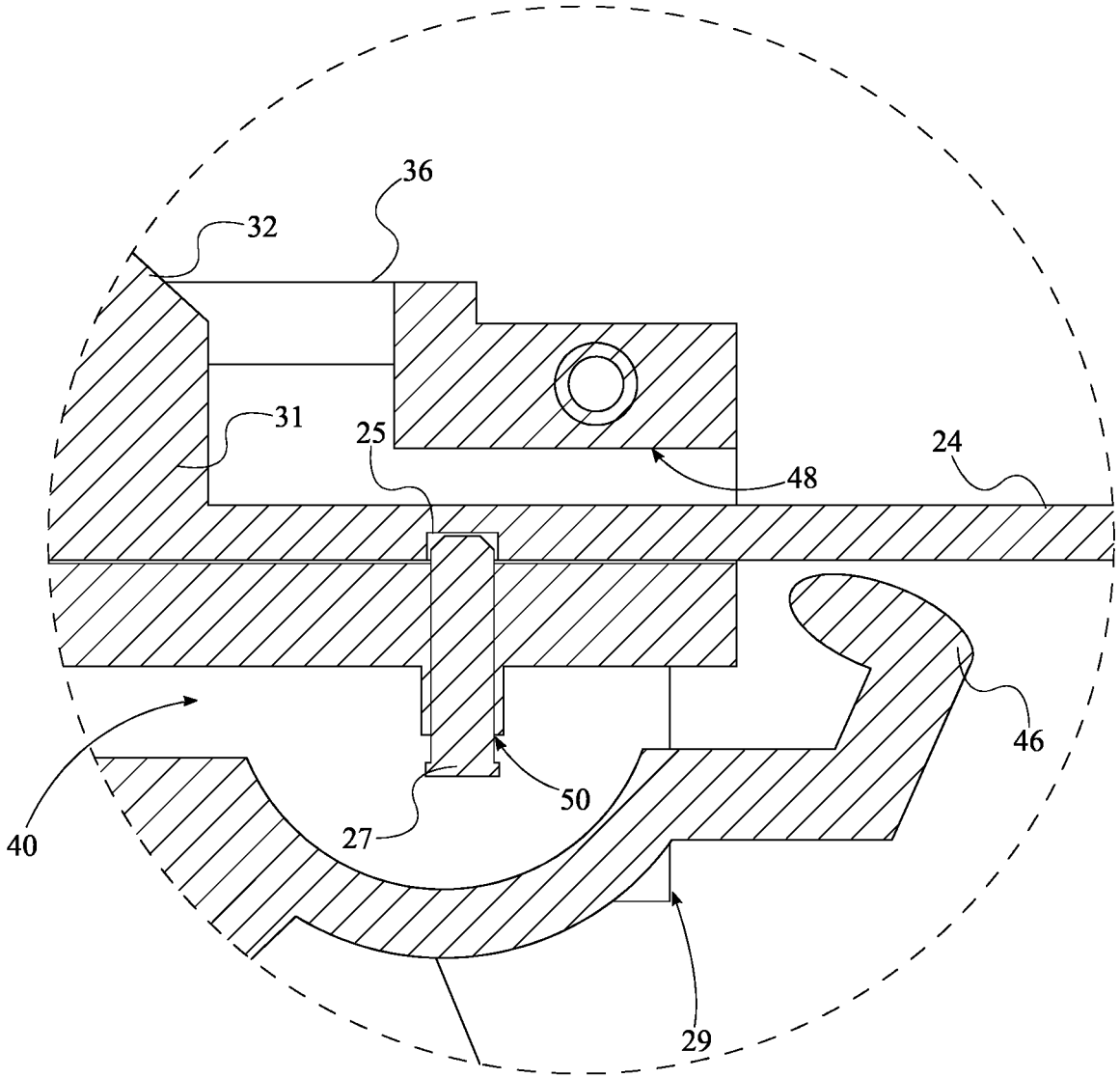
FIG. 8 is a magnified view taken about the circle 8 in FIG. 5

More specifically, the operating bar 24 is positioned along the launch channel 21. As shown in FIGS. 2, 6, and 7, the operating bar 24 traverses out of the pistol body 20 from the rear body end 29 to provide a manual cocking lever and to visually indicate that the present invention is ready to fire. Further, the retainer pin 27 is laterally mounted into the launch channel 21, and the engagement feature 25 is laterally integrated into the operating bar 24, adjacent to the carriage 22 as indicated in FIG. 8. Positioning the engagement feature 25 onto the retainer pin 27 secures the operating bar 24, and the carriage 22 by extension, in a rearward position within the launch channel 21 as shown in FIGS. 1 and 6. This constitutes the 'cocking' action, as the present invention is now ready to fire. As shown, the mainspring 23 is fully extended and places the carriage 22 under tension between the retainer pin 27 and the fore body end 28. The trigger member 26 is pivotably mounted to the pistol body 20, adjacent to the launch channel 21, positioned to separate the engagement feature 25 from the retainer pin 27 when the user squeezes the trigger member 26 as shown in FIG. 6. Dislodging the operating bar 24 from the retainer pin 27 with the trigger member 26 causes the carriage 22 to travel forward along the launch channel 21 under force form the mainspring 23, constituting the 'firing' function of the present invention. This may be done with or without at least one projectile 52, enabling a user to 'de-cock' the present invention when unloaded.

Accordingly, with the present invention positioned in the 'cocked' configuration, the present invention may further comprise at least on projectile 52 releasably positioned between the carriage 22 and the pistol body 20 as shown in FIG. 1. The at least one projectile 52 is ideally cradled against the carriage 22 to prevent accidental displacement of the at least one projectile 52, but no permanent connections are otherwise considered. Likewise, the at least one projectile 52 is configured to slide along the pistol body 20 with minimal contact during firing such that the friction between the at least one projectile 52 and the pistol body 20 is minimized. Positioned thusly, the present invention is 'loaded' and may be fired by actuating the trigger member 26 against the operating bar 24.

More specifically, the trigger member 26 is operatively coupled to the operating bar 24 as shown in FIGS. 6 and 6, wherein the trigger member 26 is used to selectively release the retainer pin 27 from the engagement feature 25. This constitutes 'firing' the present invention by allowing the carriage 22 to travel along the launch channel 21 under force from the mainspring 23. Momentum imparted to the at least one projectile 52 during the acceleration of the carriage 22 under force from the mainspring 23 provides all necessary launch energy to deliver at least one projectile 52 into a target area. The target area is broadly considered to encompass all types of target backstops, electronic game boards, target zones, or other elements of gamification as may be realized by any reasonably skilled individual.

The structure and features of the carriage 22 is essential to a successful launch of the at least one projectile 52, requiring that the at least one projectile 52 is guided during acceleration but not limited during separation. In reference to FIG. 4, the carriage 22 may comprise a base section 31, a connecting strut 32, and a projectile mount 33, while the launch channel 21 may comprise an elongated chamber 34, a guide slot 35, and a projectile track 36. As shown in FIGS. 5 and 7, the elongated chamber 34 centrally traverses into the pistol body 20 from the fore body end 28. Further, the guide slot 35 laterally traverses through the pistol body 20 and into the elongated chamber 34. The projectile track 36 is externally connected to the pistol body 20 with the projectile track 36 and is perimetrically positioned about the guide slot 35, completing an uninterrupted forward-profile of the launch channel 21. Accordingly, the connecting strut 32 is connected in between the base section 31 and the projectile mount 33 with the base section 31 being slidably mounted along the elongated chamber 34. The connecting strut 32 is positioned within the guide slot 35, and the projectile mount 33 is externally positioned to the pistol body 20, adjacent to the projectile track 36. As illustrated in FIG. 5, this slidable mechanical engagement ensures that the linear path of the carriage 22 is indexed to the launch channel 21 along the full length-of-travel of the carriage 22. The projectile mount 33 protrudes from the launch channel 21 to serve as a backstop for at least one projectile 52, cradling and indexing at least one projectile 52 into a 'launch-ready' position attached to the carriage 22.

The pistol body 20 ideally utilizes a modular construction to enable a shooter to customize and optimize their own iteration of the present invention to suit individual styles and techniques. Accordingly, the pistol body 20 comprises a receiver 38, a grip section 39, a trigger pocket 40, and at least one bracket 41. The receiver 38 constitutes a containment structure for the operable components of the present invention excluding the trigger member 26, with the grip section 39 constituting an ergonomic haft containing and supporting the trigger member 26. The separation of the receiver 38 from the grip section 39 enables the grip section 39 to be exchanged for various alternate embodiments of said grip section 39. This modularity enables a user to adapt the present invention with regards to grip angle, handle size, finger contouring, or other ergonomic considerations by installing an appropriate instance of the grip section 39. Likewise, the receiver 38 may be exchanged to adapt any embodiment of the present invention to utilize alternate embodiments of the at least one projectile 52. Further, at least one bracket 41 constitutes a universal mating component for these various instances of the receiver 38 and the grip section 39, enabling the modular exchange of these components via a common interconnecting element.

As illustrated in FIGS. 1 and 2, the grip section 39 is laterally mounted to the receiver 38 by the at least one bracket 41, releasably fixing the receiver 38 to the grip section 39 utilizing any suitable means of mechanical fastener. The grip section 39 is positioned adjacent to the rear body end 29, mimicking the ergonomic styles of a conventional automatic pistol. The trigger pocket 40 is integrated into the grip section 39, adjacent to the receiver 38 as indicated in FIG. 5 through 6, further replicating the facile structure of a conventional pistol. The trigger member 26 is pivotably mounted within the trigger pocket 40 to allow the necessary articulation of the trigger member 26 to disconnect the engagement feature 25 from the retainer pin 27, as previously outlined. The trigger pocket 40, and the positioning of the trigger member 26 therein, may be adjusted or adapted according to the various forms and styles of grip section 39 as may be selected by any individual user.

According to the primary and intended functions of the present invention, the operation of the trigger member 26 should closely approximate or simulate the function of a conventional firearm. A key element of a proper trigger-squeeze is a smooth, well-controlled pull of the trigger member 26 (or equivalent fire-control component) that does not deviate the point-of-aim from a selected target. In reference to FIG. 5 through 7, the trigger member 26 may comprise a lever body 43, a finger groove 44, a pivot pin 45, and at least one cam lobe 46 configured to simulate this functionality within the present invention. The finger groove 44 is terminally integrated into the lever body 43, ideally defining as concave surface feature matching the inner curve of a user's finger. The finger groove 44 is generally analogous to conventional trigger profiles as may be realized by any reasonably skilled individual and may be exchanged according to user preferences. Further, the at least one cam lobe 46 is terminally positioned along the lever body 43, opposite the finger groove 44. The at least one cam lobe 46 is configured to convert any rotational motion imparted upon the finger groove 44 into linear motion of the operating bar 24, by extension. Accordingly, the lever body 43 is pivotably connected to the pistol body 20 about the pivot pin 45 to define and support a limited rotation of the lever body 43 relative to the pistol body 20. As shown in FIG. 6, the pivoting action of the lever body 43 about the pivot pin 45 brings the at least one cam lobe 46 into contact with the operating bar 24. Under force from the user via the finger groove 44, the at least one cam lobe 46 gradually transacts the rotating motion of the lever body 43 into a linear motion of the operating bar 24. This motion eventually lifts the operating bar 24 clear of the retainer pin 27, allowing the carriage 22 to spring forward as previously described. It is proposed that the use of at least one cam lobe 46, as opposed to a single acute point of contact, enables the trigger member 26 to simulate the full, smooth draw of a conventional firearm trigger.

Figure 9:
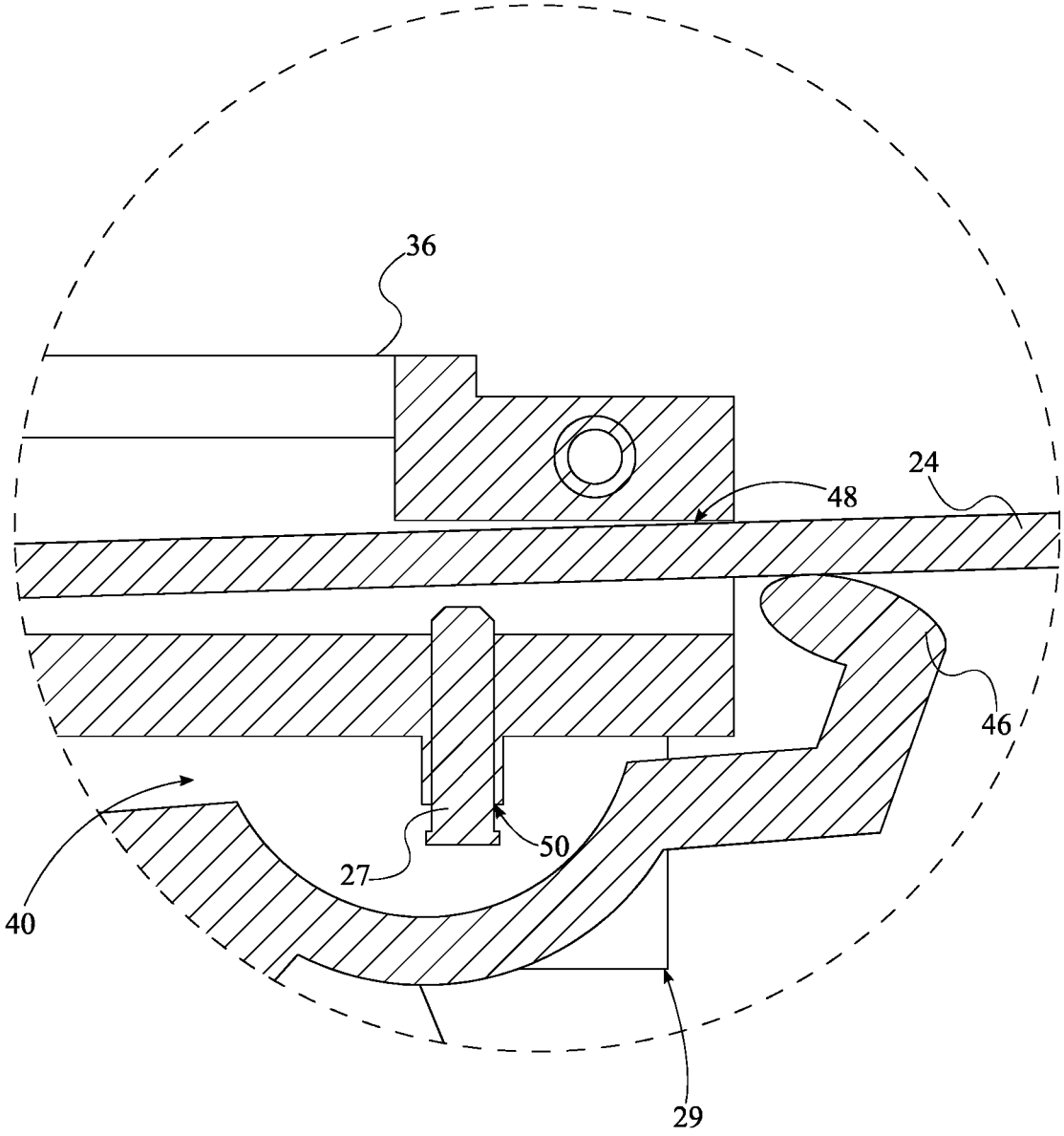
FIG. 9 is a magnified view taken about the circle 9 in FIG. 7

It is further considered that the effective difficulty of using the present invention may be increased, proportional to the skill of a user. More specifically, a mechanism capable of 'punishing' an over-extension of the trigger member 26 with a near-guaranteed missed shot may be implemented. This over-extension is a rough equivalent to a hasty or sloppy trigger squeeze on a conventional firearm (that may result in a shift in point-of-aim), further enhancing the simulacra of firearm handling skills provided by the present invention. Referring to FIG. 7, wherein the trigger member 26 and the operating bar 24 are arranged into an overextended configuration, the operating bar 24 is trapped between the launch channel 21 and the trigger member 26. More specifically, the launch channel 21 may comprise a friction-inducing section 48 with the friction-inducing section 48 positioned adjacent to the rear body end 29. As indicated in FIG. 9, the friction-inducing section 48 is laterally positioned against the operating bar 24 as the user over-squeezes the trigger member 26, effectively delaying the movement of the carriage 22 towards the fore body end 28. Consequently, at least one projectile 52 launches with lower initial velocity and likely fails to hit a target regardless of the accuracy of the user's point-of-aim.

It is further proposed that the simulated trigger-break (i.e., the position wherein a conventional trigger activates a firing sequence for a conventional weapon) of the present invention may be adjusted. In conventional firearms a sensitive trigger, or 'hair-trigger', requires very little force to actuate. This type of adjustment may be replicated by the present invention to further moderate the difficulty of executing a proper shot with the present invention or may be adjusted to suit individual user preferences. As indicated in FIGS. 8 and 9, the pistol body 20 may further comprise a conduit 50. The conduit 50 laterally traverses out of the launch channel 21 and into the rear body end 29, which allows the retainer pin 27 to be threadedly engaged into the conduit 50. This configuration enables a user (or armorer) to advance or retract the retainer pin 27 along the conduit 50, thereby increasing or decreasing the length of the retainer pin 27 that is exposed within the launch channel 21. Accordingly, the engagement feature 25 of the operating bar 24 has greater or lesser purchase on the retainer pin 27 requiring a variable degree of force via the trigger member 26 to dislodge the operating bar 24. It is further considered that advancing the retainer pin 27 into the conduit 50 limits the clearance between the retainer pin 27 and the friction-inducing section 48 of the launch channel 21, thereby reducing the range of viable trigger-squeezes without causing the penalty-braking function of a trigger over-squeeze.

It is further considered that the present invention may comprise at least one projectile 52 specifically configured for use with the novel firing mechanism described herein. The at least one projectile 52 is ideally configured as a modified dart of unconventional dimensions and weight, though it is possible for the at least one projectile 52 to define a common throwing dart of a normal type or style. As shown in FIG. 1, the at least one projectile 52 is releasably positioned against the carriage 22 and the pistol body 20. The carriage 22, as explained previously, imparts momentum to the at least one projectile 52 via the mainspring 23 once the user released the operating bar 24. The pistol body 20 serves as a launching platform as outlined above, wherein the projectile track 36 guides and directs the at least one projectile 52 under acceleration.

Figure 10:
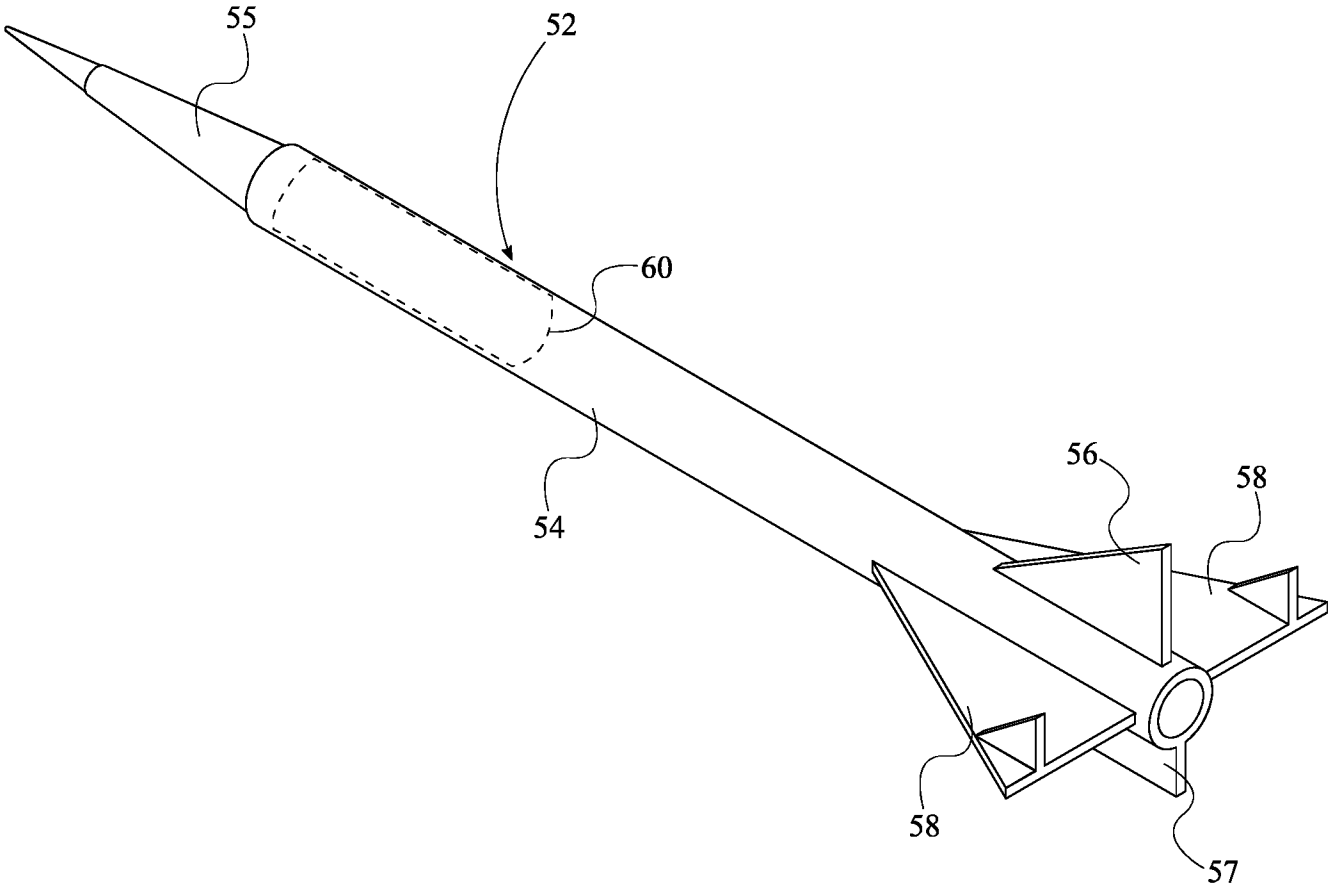
FIG. 10 is a detail view of at least one projectile in exemplary form.

In reference to FIG. 5, a preferred embodiment of the at least one projectile 52 comprises a missile body 54, a contact spike 55, a dorsal fin 56, a guide fin 57, and at least one lateral wing 58. The contact spike 55 is terminally connected to the missile body 54, providing a means for the at least one projectile 52 to puncture or stick to a target once struck. The contact spike 55 and the missile body 54 are generally similar to the tip of a conventional dart and the shaft of said dart, respectively. However, in a broader understanding of the present invention, the contact spike 55 may define any type of magnetic, adhesive, ablative, or conductive element that may indicate a strike-location on a target. The dorsal fin 56, guide fin 57, and at least one lateral wing 58 are terminally connected to the missile body 54, opposite to the contact spike 55 as illustrated in FIG. 10. The dorsal fin 56 and the guide fin 57 are positioned opposite to each other about the missile body 54 to control the yaw of the missile body 54 in flight, ideally defining any suitable static control surfaces as may be recognized by a reasonably skilled individual.

In reference to FIG. 10, the at least one lateral wing 58 is positioned in between the guide fin 57 and the dorsal fin 56 about the missile body 54, wherein the at least one lateral wing 58 is distinct in both position and geometry from the dorsal fin 56 or the guide fin 57. Unlike conventional dart-fins, wherein the fins are generally uniform in construction, the at least one lateral wing 58 presents a glide-type wing profile. This configuration separates the at least one projectile 52 from common dart-analogues by flattening the ballistic trajectory of the at least one projectile 52. This 'glide' flight path ideally presents the contact spike 55 forward to a greater extent than a simple stabilized ballistic arc, thereby maximizing the chances for the contact spike 55 to make effective contact with a target.

The at least one projectile 52 is further configured to temporarily engage into the carriage 22 and the launch channel 21 to guide a proper loading operation. More specifically, the guide fin 57 is engaged into the launch channel 21 and the dorsal fin 56 is engaged into the carriage 22 as indicated in FIG. 1. As shown, the guide fin 57 may be truncated to fit within the launch channel 21, and the dorsal fin 56 may be narrowed to slot into the projectile mount 33 of the carriage 22.

As shown in FIG. 5, the at least one projectile 52 further comprises a variable mass 60. The variable mass 60 is mounted into the missile body 54 to enable a user to adjust and adapt the at least one projectile 52 to suit a variety of game standards. This type of adjustment may comprise an adjustment of total mass, wherein the maximum range of the at least one projectile 52 using a given mainspring 23 is limited. Further, the variable mass 60 is positioned at a user-selected position along the missile body 54. This adjustability enables the center-of-mass of the at least one projectile 52 to be adapted to ensure a stable flight path between the pistol body 20 and any target.

Although the invention has been explained in relation to its preferred embodiment, it is to be understood that many other possible modifications and variations can be made without departing from the spirit and scope of the invention as hereinafter claimed.

What is claimed is:

1. A dart pistol comprising:
a pistol body;
a launch channel;
a carriage;
a mainspring;
an operating bar;
an engagement feature;
a trigger member;
a retainer pin;
the pistol body comprising a fore body end, a rear body end, and a conduit;
the launch channel traversing into the pistol body from the fore body end;
the carriage being slidably mounted along the launch channel;
the mainspring being connected in between the pistol body and the carriage;
the carriage being terminally connected to the operating bar;
the operating bar being positioned along the launch channel;
the operating bar traversing out of the pistol body from the rear body end;
the retainer pin being laterally mounted into the launch channel;
the engagement feature being laterally integrated into the operating bar, adjacent to the carriage;
the trigger member being pivotably mounted to the pistol body, adjacent to the launch channel;
the trigger member being operatively coupled to the operating bar, wherein the trigger member is used to selectively release the retainer pin from the engagement feature;
the conduit laterally traversing out of the launch channel and into the rear body end; and
the retainer pin being threadedly engaged into the conduit.

2. The dart pistol as claimed in claim 1 comprising:
the carriage comprising a base section, a connecting strut, and a projectile mount;
the launch channel comprising an elongated chamber, a guide slot, and a projectile track;
the elongated chamber centrally traversing into the pistol body from the fore body end;
the guide slot laterally traversing through the pistol body and into the elongated chamber;
the projectile track being externally connected to the pistol body;
the projectile track being perimetrically positioned about the guide slot;
the connecting strut being connected in between the base section and the projectile mount;
the base section being slidably mounted along the elongated chamber;
the connecting strut being positioned within the guide slot; and
the projectile mount being externally positioned to the pistol body, adjacent to the projectile track.

3. The dart pistol as claimed in claim 1 comprising:
the pistol body further comprising a receiver, a grip section, a trigger pocket, and at least one bracket;
the grip section being laterally mounted to the receiver by the at least one bracket;
the grip section being positioned adjacent to the rear body end;
the trigger pocket being integrated into the grip section, adjacent to the receiver; and
the at least one trigger member being pivotably mounted within the trigger pocket.

4. The dart pistol as claimed in claim 1 comprising:
the trigger member comprising a lever body, a finger groove, a pivot pin, and at least one cam lobe;
the finger groove being terminally integrated into the lever body;
the at least one cam lobe being terminally connected to the lever body, opposite the finger groove; and
the lever body being pivotably connected to the pistol body about the pivot pin.

5. The dart pistol as claimed in claim 1 comprising:
wherein the trigger member and the operating bar are arranged into an overextended configuration;
the launch channel comprising a friction-inducing section;
the friction-inducing section being positioned adjacent to the rear body end; and
the friction-inducing section being laterally positioned against the operating bar.

6. The dart pistol as claimed in claim 1 comprising:
at least one projectile; and
the at least one projectile being releasably positioned against the carriage and the pistol body.

7. The dart pistol as claimed in claim 6 comprising:
the at least one projectile comprising a missile body, a contact spike, a dorsal fin, a guide fin, and at least one lateral wing;
the contact spike being terminally connected to the missile body;
the dorsal fin, guide fin, and at least one lateral wing being terminally connected to the missile body, opposite to the contact spike;
the dorsal fin and the guide fin being positioned opposite to each other about the missile body;
the at least one lateral wing being positioned in between the guide fin and the dorsal fin about the missile body;
the guide fin being engaged into the launch channel; and
the dorsal fin being engaged into the carriage.

8. The dart pistol as claimed in claim 6 comprising:
the at least one projectile further comprising a variable mass;
the variable mass being mounted into the missile body; and
the variable mass being positioned at a user-selected position along the missile body.

* * * * *